US006569264B1

(12) United States Patent
Fukumura et al.

(10) Patent No.: US 6,569,264 B1
(45) Date of Patent: May 27, 2003

(54) SURFACE-TREATING AGENT FOR MAGNESIUM-BASED PART AND METHOD OF SURFACE TREATMENT

(75) Inventors: Kazunori Fukumura, Tokushima (JP); Takahiko Shiraishi, Tokyo (JP)

(73) Assignee: Otsuka Kagaku Kabushiki Kaisha, Osaka (JP)

( * ) Notice: Subject to any disclaimer, the term of this patent is extended or adjusted under 35 U.S.C. 154(b) by 0 days.

(21) Appl. No.: 09/869,703

(22) PCT Filed: Jan. 6, 2000

(86) PCT No.: PCT/JP00/00019

§ 371 (c)(1),
(2), (4) Date: Jul. 3, 2001

(87) PCT Pub. No.: WO00/40777

PCT Pub. Date: Jul. 13, 2000

(30) Foreign Application Priority Data

Jan. 7, 1999 (JP) ..... 11-001534
Jul. 28, 1999 (JP) ..... 11-213856

(51) Int. Cl.[7] ..... C23C 22/07

(52) U.S. Cl. ..... 148/259; 148/254; 148/260; 148/274; 148/275; 106/14.12; 106/14.13; 106/14.14; 106/14.16; 106/14.17; 252/388; 252/390; 252/396

(58) Field of Search ..... 148/254, 259, 148/260, 274, 275; 106/14.12, 14.13, 14.14, 14.16, 14.17; 252/388, 390, 396

(56) References Cited

U.S. PATENT DOCUMENTS 4,219,433 A * 8/1980 Manabe et al. ..... 252/389.2
4,657,689 A 4/1987 Darden ..... 252/75
4,851,145 A 7/1989 Van Neste et al. ..... 252/75
5,507,861 A 4/1996 Caupin et al. ..... 106/14.13

FOREIGN PATENT DOCUMENTS

| | | | |
|---|---|---|---|
| DE | 43 23 907 A1 | | 1/1995 |
| EP | 0 099 598 A1 | | 2/1984 |
| EP | 0 995 785 A1 | | 4/2000 |
| JP | 54-56040 | | 5/1979 |
| JP | 61-227186 A | | 10/1986 |
| JP | 362063686 A | * | 3/1987 |
| JP | 5-261504 | | 10/1993 |

OTHER PUBLICATIONS

English Language Translation of Japanese Patent JP 05–261504, Asahi Tec Corp., Oct. 1993.*
Patent Abstracts of Japan; Publication No. 05–261504; Publication date: Oct. 12, 1993.

* cited by examiner

*Primary Examiner*—John Sheehan
*Assistant Examiner*—Andrew L. Oltmans
(74) *Attorney, Agent, or Firm*—Kubovcik & Kubovcik

(57) ABSTRACT

The present invention provides a corrosion inhibitor composition for magnesium or magnesium alloys which contains as an effective component, at least one compound selected from among aromatic carboxylic acids and salts thereof as an effective component.

Further, the present invention provides a surface treating agent for magnesium and/or magnesium alloy components which contains a phosphate, at least one compound selected from among aromatic carboxylic acids and salts thereof, and further, as required, at least one compound selected from among pyrazole compounds and triazole compounds,and surface-treating method using the surface treating agent.

16 Claims, No Drawings

SURFACE-TREATING AGENT FOR MAGNESIUM-BASED PART AND METHOD OF SURFACE TREATMENT

This application is the National Stage Application of PCT/JP00/00019 filed Jan. 6, 2000.

TECHNICAL FIELD

The present invention relates to corrosion inhibitor compositions for magnesium or magnesium alloys and a process for inhibiting the corrosion of such metals with use of the composition.

The present invention relates also to surface treating agents and a surface treating process for shaped articles of magnesium and/or magnesium alloy, and a process for producing components made from magnesium and/or magnesium alloy.

BACKGROUND ART

Magnesium is the most lightweight of all the metals for use as practically useful structural materials, has a high specific strength, is easy to machine and therefore has found wide use for motor vehicle components, electric products such as computers and acoustic devices, aircraft components, etc. Generally, magnesium and magnesium alloys are made into shaped articles mainly by die casting, extrusion or rolling, while the so-called thixomolding process with use of an injection molding machine has been established technically in recent years. This process assures the freedom of shape of moldings, the productivity thereof and improved properties, rendering the moldings useful for wider application.

However, magnesium is the basest of all the metals for use as practically useful structural materials, therefore has the drawback of being susceptible to oxidation and needs to be inhibited from corroding as an important problem.

Magnesium or magnesium alloys are generally treated with chromates for corrosion inhibition (for example, JP-B No. 17911/1986, etc.). The chromate treatment nevertheless involves difficulty in setting the conditions for the treatment, so that it has been desired to provide more convenient corrosion inhibiting processes. Furthermore, the chromate treatment has the drawback that when conducted, the treatment discolors the surface of the metal, depriving the metal of its luster. Since the treatment uses a chromium compound, processes are more desirable which are less likely to burden the environment.

Although magnesium and/or magnesium alloys are not very costly as materials, the shaped products of magnesium and/or magnesium alloys prepared by thixomolding, extrusion, rollingor die casting have a highly active surface, which therefore becomes corroded at a high rate, necessitating a cumbersome surface treatment. The cost of this treatment inevitably makes the product two to three times as expensive as resin molding conventionally in use.

Castings or molding obtained by die casting or thixomolding are made into magnesium alloy products generally by the following steps.

1. Mechanical Pretreating Step

Polishing step with use of a polishing belt, abrasive paper or brush or by barrel finishing, buffing, blasting or the like for removing surface roughness or extraneous matter such as burrs, tough oxides, extrusion lubricant, mold releasing agent, casting sand, cutting oil or common soil.

2. Degreasing Step (1) Degreasing with solvent: Preliminary degreasing or cleaning for removing cutting oil, grease or the like with a petroleum, aromatic, hydrocarbon or chlorine solvent.

(2) Degreasing with alkali: Degreasing or cleaning with use of caustic soda or like alkali solution for removing common soil, scorched lubricant or cutting oil, etc.

(3) Degreasing with emulsion: Cleaning for removing soil from the metal surface by emulsification.

3. Pickling Step

The step of cleaning with a solution of single acid such as hydrofluoric acid, nitric acid, phosphoric acid or chromic acid or a solution of a mixture of such acids for removing oxide film, corrosion product, scorched lubricant, lodged abrasive agent, shot, casting sand or other soil which remains unremoved by the degreasing step, activating the surface of the casting or molding, or removing segregated layer.

4. Step of Chemical Conversion Treatment

The step of forming a chromate film over the surface of the casting or molding generally with use of a chromic acid agent to give corrosion resistance.

5. Drying Step

6. Coating or Plating Step

7. Assembling Step

Since magnesium is the basest of all the practically useful structural materials and has properties susceptible to oxidation, the magnesium casting or molding obtained by die casting or thixomolding requires many steps when to be made into a product for use as a component of magnesium alloy, necessitating equipment, chemical agents, labor, etc. for the steps and consequently leading to reduced productivity and an increased cost.

These steps each have drawbacks as will be described below.

1. The mechanical pretreating step produces cut chips or fine particles of magnesium due to polishing, involving the hazard of ignition or explosion and necessitating utmost care for the work.
2. The degreasing step requires good care for the disposal of waste liquid or waste water in view of the influence on the environment. Especially the release of solvents, such as chlorine solvents, which are likely to be toxic to the environment must be avoided, hence the need for a limitation on use.
3. The pickling step produces marked dimensional variations in the casting or molding.
4. The step of chemical conversion treatment, especially of chromate treatment, (1) is likely to exert an influence on the environment, (2) discolors the treated surface, depriving the surface of the metallic luster, and (3) reduces the purity of magnesium owing to contamination with chromium when the product is recycled.

The coating step has a problem as to the adhesion between the magnesium or magnesium alloy substrate and the coating formed thereon. Although the chromate film gives improved adhesion to the coating, chemical conversion treating agents of the nonchromate type are desired because of the reasons given above and the worldwide trend to impose a limitation on the use of hexavalent chromium. Presently manganese phosphate is proposed as a chemical conversion treating agent of the nonchromate type, whereas the presence of manganese in this agent is not desirable from the viewpoint that this impurity metal becomes incorporated into magnesium recycled, and manganese adversely affects the electromagnetic wave shielding properties of magnesium or magnesium alloy which are characteristic thereof although the proposed compound is almost satisfactory with respect to the adhesion of the coating.

An object of the present invention is to provide a corrosion inhibitor composition which is convenient for use in the anticorrosion treatment of magnesium or magnesium alloy while permitting the metal to retain its metallic luster despite the treatment, and which is less likely to involve environmental problems, and to also provide a process for inhibiting corrosion with use of the corrosion inhibitor composition.

Another object of the invention is to provide a surface treating agent and a surface treating process for shaped products of magnesium and/or magnesium alloy which can be used or practiced with a reduced number of steps and smaller equipment, decreased amounts of chemical agents and diminished labor to achieve improved productivity and a greater cost reduction, and also a process for producing magnesium and/or magnesium alloy components.

Still another object of the invention is to provide a surface treating agent which gives improved adhesion to coatings and produces high corrosion inhibitory effects without resulting in impaired properties to shield electromagnetic waves.

DISCLOSURE OF THE INVENTION

The present invention provides a corrosion inhibitor composition for magnesium or magnesium alloys which contains at least one compound selected from among aromatic carboxylic acids and salts thereof as an effective component.

The invention further provides a corrosion inhibitor composition for magnesium or magnesium alloys which contains at least one compound selected from among aromatic carboxylic acids and salts thereof, and at least one compound selected from among pyrazole compounds and triazole compounds.

The invention further provides a process for inhibiting corrosion of shaped magnesium articles characterized in that a molding or casting prepared from magnesium or a magnesium alloy by thixomolding or die casting is coated over the surface thereof with one of the above corrosion inhibitor compositions.

The invention further provides a surface treating agent for magnesium and/or magnesium alloy components which contains a phosphate and, at least one compound selected from among aromatic carboxylic acids and salts of the acids.

For use in surface-treating magnesium and/or magnesium alloy components, the invention provides a process for surface-treating magnesium and/or magnesium alloy components which is characterized by using a surface treating agent containing a phosphate and, at least one compound selected from among aromatic carboxylic acids and salts of the acids.

The invention further provides a process for treating magnesium and/or magnesium alloy components which process is characterized by treating the component with the surface treating agent and thereafter treating the component with the corrosion inhibitor composition.

The invention further provides a process for producing magnesium and/or magnesium alloy components with use of the surface treating agent and the surface treating process.

Given below are preferred embodiments of the invention.

(1) A corrosion inhibitor composition wherein the aromatic carboxylic acid and the salt thereof are cuminic acid, o-cuminic acid, m-cuminic acid, p-tert-butylbenzoic acid, m-toluic acid, o-toluic acid or p-toluic acid, and an alkanolamine salt of such an acid.

(2) A corrosion inhibitor composition wherein the triazole compound is 1,2,3-triazole or 1,2,4-triazole.

(3) A surface treating agent wherein the phosphate is at least one of ammonium salts or alkanolamine salts of phosphoric acids.

(4) A surface treating agent wherein the phosphate is an ammonium salt of condensed phosphoric acid (ammonium condensed phosphate).

(5) A surface treating process wherein the phosphate is at least one of ammonium salts or alkanolamine salts of phosphoric acids.

(6) A surface treating process wherein the phosphate is an ammonium salt of condensed phosphoric acid.

The corrosion inhibitor composition of the present invention contains at least one compound selected from among aromatic carboxylic acids and salts thereof. The aromatic carboxylic acid to be used is preferably a compound of the formula (1) which is substituted with $R^1$ at the first position of its benzene ring and with $R^2$, $R^3$ or $R^4$ at any one of the 2- to 6-positions of the ring, or a compound of the formula (2) which is substituted with $R^1$ at the first position of its naphthalene ring, with $R^8$ at the 8-position of the ring and with $R^2$, $R^3$, $R^4$, $R^5$, $R^6$ or $R^7$ at any one of the 2- to 7-positions.

(1)

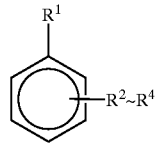

(2)

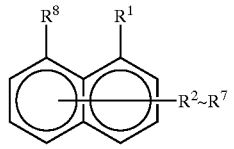

wherein $R^1$ is carboxyl, carboxymethyl or carboxyvinyl, $R^2$, $R^3$, $R^4$, $R^5$, $R^6$ and $R^7$ are the same or different and are each a hydrogen atom, hydroxyl, $C_1$–$C_8$ alkyl, nitro, a halogen atom or amino, and $R^8$ is a hydrogen atom, hydroxyl, carboxyl, carboxymethyl or carboxyvinyl.

Such aromatic carboxylic acids and salts thereof are compounds having a high corrosion inhibitory effect on magnesium and/or magnesium alloys, causing no surface discoloration and producing no influence on the subsequent treating step.

Specific examples of such carboxylic acids are benzoic acid, cuminic acid, o-cuminic acid, m-cuminic acid, p-tert-butylbenzoic acid, m-toluic acid, o-toluic acid, p-toluic acid, hydroxytoluic acid, mononitrobenzoic acid, dinitrobenzoic acid, nitrotoluic acid, nitrophthalic acid, chlorobenzoic acid, p-nitrophenylacetic acid, nitrocinnamic acid, naphthoic acid, 2-hydroxynaphthoic acid, naphthalic acid, etc.

Usable as salts of these acids are salts of such acids with various organic bases and inorganic bases. Examples of organic bases are monoethanolamine, diethanolamine, triethanolamine, monoisopropanolamine, diisopropanolamine, triisopropanolamine and like alkanolamines, methylamine, ethylamine and like alkylamines, and cyclohexylamine, DBU(1,8-diazabicyclo[5.4.0]-7-undecene), DBN(1,5-diazabicyclo[4.3.0]-5-nonene), 1-aminopyrrolidine, morpholine and like cyclic amines. Examples of inorganic bases are ammonia, TMAH (tetramethylammonium hydroxide)-and like ammonias, hydrazine, sodium hydroxide, potassium hydroxide and like alkali metal hydroxides. One of such salts is usable singly, or at least two of them are usable at the same time. These salts are more soluble in water, have a higher corrosion inhibitory effect and are therefore more preferable than aromatic carboxylic acids used as such without conversion to salts.

Among these salts, alkanolamine and like organic amine salts, ammonia salts and hydrazine salts are especially preferred because crystals will not adhere to the surface of the article treated with use of such a salt and further because these salts give satisfactory surface properties.

Examples of especially preferable aromatic carboxylic acids and salts thereof for use in the present invention are cuminic acid, o-cuminic acid, m-cuminic acid, p-tert-butylbenzoic acid, m-toluic acid, o-toluic acid, p-toluic acid, and alkanolamine salts of these acids.

It is desirable to use a pyrazole compound or triazole compound in combination with the aromatic carboxylic acid from the viewpoint of giving an improved corrosion inhibiting property to the corrosion inhibitor composition of the invention.

Examples of such pyrazole compounds are pyrazole and pyrazole derivatives having a pyrazole ring substituted with hydroxyl, $C_1$–$C_8$ alkyl, amino or nitro at the 3- to 5-positions of the ring.

More specific examples of useful pyrazole compounds are pyrazole, 3,5-dimethylpyrazole, 3-methyl-5-hydroxypyrazole, 4-aminopyrazole, etc.

Examples of such triazole compounds are 1,2,3-triazole, 1,2,4-triazole, benzotriazole and like triazole compounds, and triazole derivatives comprising such a triazole compound substituted with $C_1$–$C_8$ alkyl, mercapto, hydroxyl or the like at a desired position.

More specific examples of such triazole compounds are 1,2,3-triazole, 1,2,4-triazole, 3-mercapto-1,2,4-triazole, 3-hydroxy-1,2,4-triazole, 3-methyl-1,2,4-triazole, 1-methyl-1,2,4-triazole, 1-methyl-3-mercapto-1,2,4-triazole, 4-methyl-1,2,3-triazole, benzotriazole, 1-hydroxybenzotriazole, etc. Especially preferable among these are 1,2,3-triazole, 1,2,4-triazole, 3-mercapto-1,2,4-triazole, 3-hydroxy-1,2,4-triazole and benzotriazole, and more preferable are 1,2,3-triazole and 1,2,4-triazole. These pyrazole compounds or triazole compounds are usable singly, or at least two of them can be used at the same time.

The composition of the present invention is usable as it is or as dissolved in a suitable solvent, while it is desirable to use the composition in the form of an aqueous solution.

Although aromatic carboxylic acids and salts thereof can be incorporated into the composition of the invention in amounts determined suitably, the combined amount of such compounds can be, for example, usually 0.01 to 30 wt. %, preferably 0.1 to 10 wt. %.

When to be used, the pyrazole compound or triazole compound is used in an amount of 0.01 to 30 wt. %, preferably 0.1 to 10 wt. %. The ratio by weight of the aromatic carboxylic acid and salt thereof to the pyrazole compound or triazole compound can be, for example, 10:1 to 1:10.

The magnesium or magnesium alloy for which the corrosion inhibitor composition of the present invention is usable is not limited specifically. The composition is usable for magnesium as a single metal and a wide variety of alloys or composite materials comprising magnesium and other metals. Examples of other metals are aluminum, zinc, manganese, iron, nickel, copper, lead, tin and calcium. One or at least two metals can be selected from among these metals for use.

The corrosion inhibitor composition of the invention can be applied to the surfaces of ingots, chips or various shaped articles to be treated, by spraying, coating with a roll coater or impregnation with use of a treating bath. The temperature for the corrosion inhibiting treatment, which is suitably determined, is usually 0 to 100° C., preferably room temperature to about 80° C.

When the molding or casting obtained by thixomolding or die casting is treated over the surface thereof with the corrosion inhibitor composition of the invention, the molding or casting can be distributed or stored for a long period of time before coating. This contributes greatly to the rationalization of the manufacturing process. The magnesium alloy molding or casting conventionally prepared by thixomolding or die casting (hot-chamber die casting and cold-chamber die casting) has its surface corroded at a high rate and therefore needs to be coated immediately after preparation, or to be treated temporarily with a corrosion inhibitor which is to be removed before coating, whereas the article surface treated with the corrosion inhibitor composition of the invention can be directly coated free of any adverse influence of the composition, so that there is no need for the removal step conventionally required.

To achieve an enhanced inhibitory effect, the article to be treated is preferably degreased and cleaned over the surface before the inhibitor composition of the invention is used.

The amount of the corrosion inhibitor composition of the present invention to be used is not limited specifically but may be such that the surface of the article to be treated can be uniformly covered with the composition. For example, the composition can be used in an amount of about 10 to about 300 ml per square meter of the surface to be treated.

The ingot or chips as treated with the corrosion inhibitor composition of the invention can be used as it is as the material to be shaped without removing the composition. The shapability of the material or the shaped product is then in no way adversely affected by the composition.

When the corrosion inhibitor composition of the invention is used for shaped articles, the article having the composition applied thereto can be coated directly without providing the step of removing the composition, hence the outstanding advantage that the coated article can be very easily prevented from developing corrosion or becoming discolored.

Examples of phosphates for use in the surface treating agent of the present invention are alkali metal salts, ammonium salts and alkanolamine salts of orthophosphoric acid, condensed phosphoric acids or like phosphoric acids.

Examples of condensed phosphoric acids are metaphosphoric acids and polyphosphoric acids. Examples of metaphosphoric acids are trimetaphosphoric acid, tetrametaphosphoric acid, etc. Examples of polyphosphoric acids are pyrophosphoric acid, triphosphoric acid, tetraphosphoric acid and the like.

More specific examples of phosphates are sodium primary phosphate, sodium secondary phosphate, sodium tertiary phosphate, potassium primary phosphate, potassium secondary phosphate, potassium tertiary phosphate, ammonium primary phosphate, ammonium secondary phosphate, ammonium tertiary phosphate, monoethanolamine salt of phosphoric acid, diethanolamine salt of phosphoric acid, triethanolamine salt of phosphoric acid, isopropanolamine salt of phosphoric acid, sodium salt of trimetaphosphoric acid, potassium salt of trimetaphosphoric acid, ammonium salt of trimetaphosphoric acid, sodium salt of tetrametaphosphoric acid, ammonium salt of tetrametaphosphoric acid, ethanolamine salt of tetrametaphosphoric acid, sodium salt of triphosphoric acid, potassium salt of triphosphoric acid, ammonium salt of triphosphoric acid, sodium salt of tetraphosphoric acid, potassium salt of tetraphosphoric acid, ammonium salt of tetraphosphoric acid, etc. These phosphates can be used singly, or at least two of them are usable in combination.

Among these, ammonium salts and alkanolamine salts of phosphoric acids are desirable since they have a suitable etching effect and are less likely to produce smut after cleaning. More desirable are ammonium salts of condensed phosphoric acids because they have high safety, permit facilitated waste water disposal, are capable of readily etching the surface of magnesium and/or magnesium alloy and are unlikely to etch to excess.

The ammonium salts of condensed phosphoric acids are known. Such a salt can be obtained, for example, by heating orthophosphoric acid (normal phosphoric acid) and urea for condensation. In this case, the reaction is conducted preferably under such a condition that the molar ratio of orthophosphoric acid to urea is 1:0.5 to 1:5. The surface treating agent may contain the unreacted materials in the reaction mixture, i.e., orthophosphoric acid and urea, and is usable without giving any problem to the advantage of the invention. The degree of condensation of the ammonium salt of condensed phosphoric acid is not limited particularly, but the acid may have a condensation degree of about 2 to about 3.

The phosphoric acid salt is used usually in an amount of about 0.5 to about 50 wt. %, preferably about 2 to about 5 wt. %, based on the whole amount of the surface treating agent of the present invention. If the amount is much greater than 50 wt. %, the surface of magnesium becomes colored black after cleaning, whereas if the amount is less than 0.5 wt. %, insufficient etching will result, failing to produce a full degreasing effect.

Examples of aromatic carboxylic acids and salts thereof for use in the surface treating agent of the present invention can be aromatic carboxylic acids represented by the foregoing formula (1) or (2), and salts thereof.

Preferred aromatic carboxylic acids, more specific examples such acids, salts of such aromatic carboxylic acids, and preferred examples of such salts are the same as those given above.

The concentration of aromatic carboxylic acids and salts thereof for use is usually about 0.01 to about 30 wt. %, preferably about 0.1 to about 10 wt. %, based on the whole amount of the surface treating composition. If the concentration is much higher than 30 wt. %, the surface treating agent will exhibit a lower etching rate, necessitating a longer period of time for the treatment, whereas if the concentration is lower than 0.01 wt. %, the surface treating agent colors the surface of magnesium black and fails to produce a sufficient effect although etching the metal progressively. The composition can be produced, stored and transported with its components held at high concentrations, and is to be diluted for actual use.

At least one compound selected from among pyrazole compounds and triazole compounds can be used in combination with the aromatic carboxylic acid and salt thereof in the surface treating agent of the present invention. The same compounds as exemplified above are usable as pyrazole compounds and triazole compounds.

The ratio by weight of aromatic carboxylic acids and salts thereof to the pyrazole compound or triazole compound can be, for example, 10:1 to 1:10. It is desirable to use the pyrazole compound or triazole compound in combination with the aromatic carboxylic acid and salt thereof from the viewpoint of giving synergistically improved corrosion inhibitory properties.

Various additives, such as surfactants and chelate agents, can be incorporated into the corrosion inhibitor and the surface treating agent of the present invention. The surfactant is preferably nonionic and is about 13 to about 20 in HLB value to be suitable. The concentration of the surfactant, although determined suitably, is usually 0.001 to 5 wt. %, preferably about 0.01 to about 3 wt. %. Examples of useful chelate agents are disodium salts of ethylenediaminetetraacetic acid (EDTA-2Na), sodium gluconate, phosphonic acid salts, etc. The concentration of the chelate agent, although determined suitably, is usually 0.1 to 10 wt. %, preferably about 1 to about 5 wt. %.

Although the surface treating composition of the present invention can be used as it is or as dissolved in a suitable solvent, it is desirable to use the composition in the form of an aqueous solution. The temperature for the treatment, which is suitably determined, is usually 0 to 100° C., preferably room temperature to about 60° C.

The magnesium or magnesium alloy for which the surface treating composition of the present invention is usable is not limited specifically. The composition is usable for magnesium as a single metal and a wide variety of alloys or composite materials comprising magnesium and other metals. Examples of other metals are aluminum, zinc, manganese, iron, nickel, copper, lead, tin and calcium. One or at least two metals can be selected from among these metals for use.

The material to be treated is treated with the surface treating agent of the invention and then washed with water when required. Preferably, the material is thereafter cleaned with a solvent for removing from the surface fine particulate substances such as metal powder and carbon. Examples of solvents usable are methanol, ethanol, isdpropanol and like alcohols, acetone, methyl ethyl ketone and like ketones, trichloroethane, trichloroethylene, Perclene and like chlorine-containing solvents, limonene and like terpenes, aqueous solutions of alkalis such as sodium hydroxide, potassium hydroxide, sodium orthosilicate and sodium metasilicate, etc. These solvents can be used preferably at a concentration of 1 to 100%, preferably 5 to 50%, and at a temperature of room temperature to 100° C., preferably room temperature to 50° C.

The surface treating composition of the present invention can be applied to the surfaces of shaped articles prepared as by thixomolding, extrusion, rolling or die casting, for example, by spraying, coating with a spray or roll coater, or impregnation with use of a treating bath.

According to the present invention, the surfaces of shaped articles of magnesium and/or magnesium alloy prepared as by thixomolding, extrusion, rolling or die casting can be readily cleaned and treated for corrosion inhibition. This greatly simplifies the conventional manufacturing process for producing components of magnesium and/or magnesium alloy.

More specifically, some or all of the conventional degreasing step, pickling step and chemical conversion treatment step described can be replaced by the treatment with the surface treating composition of the present invention. Further in the mechanical pretreatment following casting, molding or shaping process, the treatment for giving a uniform surface, cleaning or corrosion inhibition can be replaced by the treatment with the surface treating agent of the invention although it may be necessary to conduct, for example, deburring treatment.

Briefly stated, parts or components of magnesium and/or magnesium alloys can be produced ideally according to the invention from moldings or castings of magnesium and/or magnesium alloys obtained by thixomolding or die casting, by (1) deburring the molded or cast articles when required, (2) treating the articles with the surface treating agent of the invention, (3) washing the articles with water and treating the articles for corrosion inhibition when required, (4) drying the articles, (5) coating or plating the articles or treating the articles for anodic oxidation, and (6) thereafter assembling the articles.

Incidentally, the articles washed with water by step (3) can be treated thereafter with a corrosion inhibitor. This further improves the corrosion inhibitory or like surface protecting effect to be producedby the following step (5) of coating, plating or the like on the magnesium and/or magnesium alloy articles. Examples of useful corrosion inhibitors are the aromatic carboxylic acids, salts thereof, pyrazole compounds and triazole compounds described above for use in the invention. It is desirable to use an aqueous solution containing at least one of these compounds. While the amount of the inhibitor to be used should be adjusted suitably depending on the kind thereof, the amount is generally 0.01 to 30 wt. % based on the whole amount of the corrosion inhibitory solution. The solution is applied to the magnesium and/or magnesium alloy articles as washed with water by spraying, coating with use of a roll coater or dipping in the solution.

It has become possible to solve or relieve the problems involved in the conventional surface treating step. Additionally, the invention improves the equipment conventionally required, decreases the amounts of chemicals, labor, etc. to be used in various step, and is expected to achieve improved productivity and cost reductions.

When treated with the surface treating composition of the present invention, moldings or castings can be distributed or stored before being coated or plated, while the film formed on the surface by the treatment will not be adversely affected by the coating, plating or anodic oxide film to be subsequently formed over the treated surface. This eliminates the need for a removal step, contributing to further rationalization of the process for producing magnesium and/or magnesium alloy parts or components. When magnesium substrates are directly coated conventionally, the adhesion of the coating poses a problem, whereas the film formed on the surface by the treatment gives satisfactory adhesion to the coating.

BEST MODE OF CARRYING OUT THE INVENTION

Although the invention will be described below with reference to examples and comparative examples, the invention is not limited to the examples. The parts are by weight.

EXAMPLE 1

A 10% aqueous solution of isopropanolamine salt of p-tert-butylbenzoic acid was prepared to obtain a corrosion inhibitor composition of the invention.

EXAMPLE 2

A corrosion inhibitor composition of the invention was prepared by mixing together a 10% aqueous solution of isopropanolamine salt of m-toluic acid and a 10% aqueous solution of 1,2,4-triazole.

COMPARATIVE EXAMPLE 1

A 10% aqueous solution of isopropanolamine salt of azelaic acid was prepared to obtain a corrosion inhibitor composition for comparison.

COMPARATIVE EXAMPLE 2

A 10% aqueous solution of bezotriazole was prepared to obtain a corrosion inhibitor composition for comparison.

COMPARATIVE EXAMPLE 3

A 10% aqueous solution of 1,2,4-triazole was prepared to obtain a corrosion inhibitor composition for comparison.

COMPARATIVE EXAMPLE 4

A 10% aqueous solution of 2-mercaptobezothiazole was prepared to obtain a corrosion inhibitor composition for comparison.

TEST EXAMPLE 1

The corrosion inhibitor compositions of Examples and Comparative Examples were each diluted to concentrations of 10%, 20% and 50% with deionized water containing 0.1% of a polyoxyethylene alkyl ether (nonionic surfactant, Lion Corporation, Laol XA 60/50, 13.3 in HLB value) added thereto to prepare treating solutions. Deionized water containing only 0.1% of the surfactant added thereto was used as a control.

Test pieces in the form of plates, 6.35 mm×90 mm×180 mm, and cut off from an extrudate (3% Al, 1% Zn, 96% Mg) of magnesium alloy AZ31 (ASTM), and test pieces in the form of plates, 6.35 mm×90 mm×180 mm, and prepared from chips (9% Al, 1% Zn, 90% Mg) of magnesium alloy AZ91D (ASTM) by thixomolding were polished with emery paper #800 first over the surface, then degreased for the cleaning of the surface, dipped in each treating solution or control solution and withdrawn therefrom. Four test pieces of each alloy were fitted together in layers and clamped under pressure.

The resulting assembly was allowed to stand in the atmosphere at room temperature at relative humidity of 90 to 95% for 7 days and checked for corrosion by observing the degree of discoloration with the unaided eye. The results achieved using AZ31 are given in Table 1, and those attained using AZ91D in Table 2.

◎ No discoloration: white

○ Slight to some discoloration: yellow

Δ Medium discoloration: gray

X Marked discoloration: black

TABLE 1

| | concentration | | |
|---|---|---|---|
| Treating solution | 10% | 20% | 50% |
| Control soltuion | X | X | X |
| Ex. 1 | Δ | Δ | ○ |
| Ex. 2 | ○ | ○ | ○ |
| Com. Ex. 1 | X | X | X |
| Com. Ex. 2 | X | X | Δ |
| Com. Ex. 3 | Δ | Δ | X |
| Com. Ex. 4 | X | X | Δ |

TABLE 2

| Treating solution | concentration 10% | 20% | 50% |
|---|---|---|---|
| Control soltuion | X | X | X |
| Ex. 1 | Δ | ○ | ○ |
| Ex. 2 | ○ | ○ | ○ |
| Com. Ex. 1 | X | X | X |
| Com. Ex. 2 | X | X | Δ |
| Com. Ex. 3 | Δ | X | X |
| Com. Ex. 4 | X | X | Δ |

EXAMPLES 3 TO 11

Five parts of p-tert-butylbenzoic acid, 1 part of 1,2,4-triazole, 2.5 parts of a polyoxyethylene alkyl ether (Laol XA60/50) and 5 parts of diethanolamine were placed into deionized water and dissolved therein to obtain 100 parts of a corrosion inhibitor composition of Example 3.

Corrosion inhibitor compositions of Examples 4 to 11 were similarly prepared from the compounds listed in Tables 3 and 4 and used in the listed amounts.

TABLE 3

| | Example 3 | 4 | 5 | 6 | 7 |
|---|---|---|---|---|---|
| p-tert-butylbenzoic acid | 5 | 5 | — | — | — |
| o-toluic acid | — | — | 5 | — | — |
| m-toluic acid | — | — | — | 5 | 5 |
| p-toluic acid | — | — | — | — | — |
| Benzoic acid | — | — | — | — | — |
| 1,2.4-triazole | 1 | 1 | 1 | 1 | 1 |
| benzotriazole | — | — | — | — | — |
| polyoxyethylene alkyl ether | 2.5 | — | 2.5 | 2.5 | — |
| diethanolamine | 5 | 5 | 5 | 5 | 5 |
| isopropanolamine | — | — | — | — | — |

TABLE 4

| | Example 8 | 9 | 10 | 11 |
|---|---|---|---|---|
| p-tert-butylbenzoic acid | — | 5 | — | — |
| o-toluic acid | — | — | — | — |
| m-toluic acid | — | — | 5 | — |
| p-toluic acid | 5 | — | — | — |
| Benzoic acid | — | — | — | 5 |
| 1,2,4-triazole | 1 | 1 | 1 | 1 |
| Benzotriazole | — | — | — | — |
| polyoxyethylene alkyl ether | 2.5 | 2.5 | 2.5 | 2.5 |
| diethanolamine | 5 | — | — | 5 |
| isopropanolamine | — | 5 | 5 | — |

TEST EXAMPLE 2

Treating solutions were prepared by diluting the above corrosion inhibitor compositions and comparative treating agents with deionized water. Test pieces were tested for corrosion in the same manner as in Test Example 1 except that the test pieces used were prepared from chips (9% Al, 1% Zn, 90% Mg) of magnesium alloy AZ91D (ASTM) by thixomolding. Table 5 shows the results.

TABLE 5

| | concentration 50% | 100% |
|---|---|---|
| Ex. 3 | ○ | ◎ |
| Ex. 4 | ○ | ◎ |
| Ex. 5 | ○ | ◎ |
| Ex. 6 | ○ | ◎ |
| Ex. 7 | ○ | ◎ |
| Ex. 8 | ○ | ◎ |
| Ex. 9 | ○ | ◎ |
| Ex. 10 | ○ | ◎ |
| Ex. 11 | X | Δ |

EXAMPLE 12

Preparation of Surface Treating Agent (1)

Five parts of an ammonium salt of condensed phosphoric acid and 8 parts of isopropanol amine salt of p-tert-butylbenzoic acid were placed into deionized water and dissolved therein to obtain 100 parts of surface treating agent (1). Incidentally the ammonium condensed phosphate used was obtained by mixing together orthophosphoric acid and urea in a molar ratio of 1:2 and reacting the mixture for condensation at 150 to 160° C. for 2 hours, and contained unreacted urea and orthophosphoric acid. The ammonium condensed phosphate was 2 to 3 in the degree of condensation. The same ammonium condensed phosphate as above was used in Examples and Comparison Examples to follow.

EXAMPLE 13

Preparation of Surface Treating Agent (2)

Twenty parts of ammonium condensed phosphate, 2 parts of isopropanolamine salt of m-toluic acid and 2 parts of 1,2,4-triazole were placed into deionized water and dissolved therein to obtain 100 parts of surface treating agent (2).

EXAMPLE 14

Preparation of Surface Treating Agent (3)

Ten parts of ammonium condensed phosphate, 5 parts of isopropanolamine salt of p-tert-butylbenzoic acid and 5 parts of 1,2,4-triazole were placed into deionized water and dissolved therein to obtain 100 parts of surface treating agent (3).

COMPARATIVE EXAMPLES 5 to 10

The following aqueous solutions were prepared for comparison.

(5) 5% Aqueous solution of ammonium condensed phosphate.

(6) 5% Aqueous solution of orthophosphoric acid.

(7) 5% Aqueous solution of sodium hydroxide.

(8) 5% Aqueous solution of citric acid.

(9) 5% aqueous solution of glycolic acid.

(10) Deionized water.

TEST EXAMPLE 3

The test pieces used were cast plates (10×15×0.2 cm) prepared from magnesium alloy AZ91D (containing 90% of magnesium, 9% of aluminum and 1% of zinc) using a die casting machine (product of Toshiba) wherein the die was coated with a release agent (Caster Ace 225, product of Nichibei Co., Ltd.) The test pieces had the release agent adhering to their surfaces. Test pieces were dipped in each of the aqueous solutions of Examples 12 to 14 and Comparison Examples 5 and 6 at 20° C. for 1 minute, washed with running water, dried in a hot air stream (120° C. for 3 minutes) and checked for the cleaning property and smut (black color change) inhibitory effect of the solution.

Cleaning Property Test

Each test piece was dipped in deionized water (25° C. for 1 minute) and checked for the area wet with water 30 seconds after the dipping. Table 6 shows the result in terms of an area ratio.

Smut Inhibitory Effect

Each of the test pieces was checked for reflectivity of light before and after the test by a color-measuring color difference meter (product of Nippon Denshoku Kogyo Co., Ltd., SE2000) Table 6 shows the result in terms of an L value (light reflectivity after test—light reflectivity before test).

Surface State

The surface of each test piece was checked with the unaided eye. The test piece with a uniform and smooth surface was indicated by ○, and the test piece with an uneven and irregular surface by X. Table 6 shows the result.

TABLE 6

| | cleaning property | L value | surface state |
|---|---|---|---|
| surface treating agent (1) | 100 | +2 | ○ |
| surface treating agent (2) | 100 | +2 | ○ |
| surface treating agent (3) | 100 | +3 | ○ |
| Com. Ex. 5 | 100 | −16 | ○ |
| Com. Ex. 6 | 100 | −18 | ○ |
| Com. Ex .7 | 100 | −10 | X |
| Com. Ex. 8 | 100 | −19 | X |
| Com. Ex. 9 | 100 | −22 | X |
| Com. Ex.10 | 0 | 0 | ○ |

It was found that the simple treatment of dipping test pieces in the surface treating compositions for use in the invention readily removed the release agent and uniformly etched the test piece. Additionally, the compositions were found to completely inhibit the magnesium alloy from smutting, permitting the alloy to retain the original luster. Although the release agent was removable with the solutions of Comparative Examples 5 to 9, these solutions produced smut, while the solutions of Comparative Examples 7 to 9 etched the alloy excessively and unevenly.

TEST EXAMPLE 4

Molded plates (10×15×0.2 cm) prepared from magnesium alloy AZ91D by thixomolding using a mold coated with Caster Ace 225 were dipped in 20 L of a surface treating agent (45° C.).

During the treatment, the dipped plates were irradiated with ultrasonic waves (26 kHz in frequency) by an ultrasonic generator (product of Kaijo Co., Ltd., Model Phoenix CA-63) for 1 minute. The plates were washed with running water and then dipped in 20 L of a corrosion inhibitor composition (20° C.) for 1 minute. After air blowing, the molded plates were dried as positioned upright in a hot air stream (80° C. for 2 minutes) to obtain treated moldings. The treated moldings obtained were coated in the following manner.

[Coating 1] Some of the moldings were coated with a metallic satin powder coating composition by a coater (product of Nihon Parkerizing Co., Ltd.) and baked (200° C. for 15 minutes) to prepare test pieces.

[Coating 2] The other moldings were coated with an under coat composition, Mg primer (product of Tokyo Gotoh Co., Ltd., Mg Coat I) by a spray gun (product of Iwata Co., ltd., W61-2G) and thereafter with a top coat composition which wasan acrylic-type metallic coating composition (product of Kuboko Paint Co., Ltd.) by a spray gun and baked (140° C. for 20 minutes) to prepare test pieces. Table 7 shows the treatments conducted for the test pieces.

TABLE 7

| | surface treating agent | Corrosion inhibitor composition | Coating |
|---|---|---|---|
| test piece (1) | surface treating agent (1) | Corrosion inhibitor 1 | coating 1 |
| test piece (2) | Com. Ex. 11 | Corrosion inhibitor 1 | coating 1 |
| test piece (3) | Com. Ex. 11 | Deionized water | coating 1 |
| test piece (4) | surface treating agent (1) | Corrosion inhibitor 1 | coating 2 |
| test piece (5) | Com. Ex. 11 | Corrosion inhibitor 1 | coating 2 |
| test piece (6) | Com. Ex. 11 | Deionized water | coating 2 |

Comparative Example 11: 2.5% aqueous solution of polyoxyethylene alkyl ether.

Corrosion inhibitor 1: 0.1% aqueous solution of isopropanolamine salt of p-tert-butylbenzoic acid (the solution of Example 1, as diluted 100 times).

Initial Adhesion Test

Test pieces (1) to (6) were subjected to a cross-cut test.

TABLE 8

| | initial adhesion test crosscut-cut test |
|---|---|
| test piece (1) | 100/100 |
| test piece (2) | 10/100 |
| test piece (3) | 0/100 |
| test piece (4) | 100/100 |
| test piece (5) | 35/100 |
| test piece (6) | 15/100 |

Secondary Adhesion Test

X-cuts were made in test pieces (1), (2) and (4), and a 5% aqueous solution of sodium chloride was sprayed onto the test pieces continuously at 35° C. for 120 hours. An adhesive tape (18 mm in width) was completely adhered to each test piece along the cut portion and thereafter peeled off instantaneously. The test piece was then checked for the separation of the coating. The width of the coating peeled off was measured.

The state of the test piece having its coating peeled off was evaluated according to the scores prescribed in the X-cut Tape Method (JIS K 5400 8.5.3). Table 9 shows the results.

TABLE 9

| | secondary adhesive test | |
|---|---|---|
| | score of separation state | Width of Separation (mm) |
| test piece (1) | 10 | 0 |
| test piece (2) | 2 | 5~6 |
| test piece (4) | 10 | 0 |

TEST EXAMPLE 5

The same molded plates as described with reference to Test Example 4 were used for this test.

Preparation of Test Pieces (7)

Treated moldings obtained by the method described in Test Example 4 using surface treating agent (1) were used as test pieces (7).

Preparation of Test Pieces (8)

Molded plates were cleaned by the following procedure.

1) Dipping for 4 minutes in 1 L of an alkali cleaning solution (70° C.) containing 40 g of sodium pyrophosphate, 15 g of sodium fluoride and 70 g of borax per liter, 2) washing with water, 3) dipping in 1 L of 50% (w/v) aqueous solution of phosphoric acid (room temperature) for 0.5 minute, 4) washing with water, 5) dipping in 1 L of 5% (w/v) aqueous solution of sodium hydroxide (room temperature) for 0.5 minute, 6) washing with water.

The molded plates thus cleaned were dipped in 1 L (room temperature) of improved chromic acid (Dow 20, product of Dow Chemical Corporation) for 0.5 minute and washed with water and then with hot water to obtain testpieces (8).

Preparation of Test Pieces (9)

Molded plates cleaned by the procedure described for test pieces (8) were dipped in 1L of an aqueous solution (40° C.) of manganese phosphate containing 100 g of ammonium dihydrogenphosphate and 20 g of potassium permanganate per liter and adjusted to a pH of 3.5 with orthophosphoric acid for 15 minutes and washed with water to obtain test pieces (9).

Resistivity Test

The resistance value of each test piece was measured at desired three points on its surface by a four-terminal four-probe system (probe: ESP type) using contact resistance meter, Loresta MP (product of Dia Instruments Co., Ltd.) Table 10 shows the result in terms of an average value.

TABLE 10

| | contact resistance value (mΩ) |
|---|---|
| test piece (7) | 0.03 |
| test piece (8) | 0.03 |
| test piece (9) | >1.0 |

Table 10 reveals that test piece (7) treated with surface treating agent (1) of the invention is as low as test piece (8) treated with Dow 20 which is a surface treating agent of the chromic acid type conventionally in use, hence a high electromagnetic wave shielding property.

EXAMPLES 15 TO 22

A surface treating agent (100 parts) of Example 15 was obtained by placing 4 parts of an ammonium condensed phosphate, 5 parts of p-tert-butylbenzoic acid, 1 part of 1,2,4-triazole, 2.5 parts of a polyoxyethy-lene alkyl ether (Laol XA60/50) and 5 parts of diethanolamine into deionized water and preparing a solution.

Surface treating agents were prepared similarly, using the compounds listed in Tables 11 and 12 in listed amounts.

TABLE 11

| | Example | | | | |
|---|---|---|---|---|---|
| | 15 | 16 | 17 | 18 | 19 |
| ammonium condensed phosphate | 4 | 4 | 4 | 4 | 4 |
| p-tert-butylbenzoic acid | 5 | — | — | — | — |
| o-toluic acid | — | 5 | — | — | — |
| m-toluic acid | — | — | 5 | 5 | — |
| p-toluic acid | — | — | — | — | 5 |
| benzoic acid | — | — | — | — | — |
| 1,2,4-triazole | 1 | 1 | 1 | 1 | 1 |
| benzotriazole | — | — | — | — | — |
| polyoxyethylene alkyl ether | 2.5 | 2.5 | 2.5 | — | 2.5 |
| diethanolamine | 5 | 5 | 5 | 5 | 5 |
| isopropanolamine | — | — | — | — | — |

TABLE 12

| | Example | | |
|---|---|---|---|
| | 20 | 21 | 22 |
| ammonium condensed phosphate | 4 | 4 | 4 |
| p-tert-butylbenzoic acid | 5 | — | — |
| o-toluic acid | — | — | — |
| m-toluic acid | — | 5 | — |
| p-toluic acid | — | — | — |
| benzoic acid | — | — | 5 |
| 1,2,4-triazole | 1 | 1 | 1 |
| benzotriazole | — | — | — |
| polyoxyethylene alkyl ether | 2.5 | 2.5 | 2.5 |
| diethanolamine | — | — | 5 |
| isopropanolamine | 5 | 5 | — |

TEST EXAMPLE 6

The surface treating agents of Examples 15 to 22 were tested for cleaning property in the same manner as in Test Example 3 with the exception of using these agents. Table 13 shows the results.

TABLE 13

| | cleaning property (%) |
|---|---|
| Ex. 15 | 100 |
| Ex. 16 | 100 |
| Ex. 17 | 100 |
| Ex. 18 | 100 |
| Ex. 19 | 100 |
| Ex. 20 | 100 |
| Ex. 21 | 100 |
| Ex. 22 | 100 |

TEST EXAMPLE 7

The surface treating agents of Examples 15 to 22 were subjected to a cross-cut test in the same manner as in Test Example 4 with the exception of using these agents. The treatments conducted for the test pieces are listed in Table 14, and the results in Table 15.

TABLE 14

| | Surface treating agent | post-treating agent | Coating |
|---|---|---|---|
| test piece (10) | Ex. 15 | Ex. 3 | coating 1 |
| test piece (11) | Ex. 16 | Ex. 5 | coating 1 |
| test piece (12) | Ex. 17 | Ex. 6 | coating 1 |
| test piece (13) | Ex. 18 | Ex. 7 | coating 1 |
| test piece (14) | Ex. 19 | Ex. 8 | coating 1 |
| test piece (15) | Ex. 20 | Ex. 9 | coating 1 |
| test piece (16) | Ex. 21 | Ex. 10 | coating 1 |
| test piece (17) | Ex. 15 | Ex. 6 | coating 1 |
| test piece (18) | Ex. 22 | Ex. 11 | coating 1 |

TABLE 15

| | cross-cut test |
|---|---|
| test piece (10) | 100/100 |
| test piece (11) | 100/100 |
| test piece (12) | 100/100 |
| test piece (13) | 100/100 |
| test piece (14) | 100/100 |
| test piece (15) | 100/100 |
| test piece (16) | 100/100 |
| test piece (17) | 100/100 |
| test piece (18) | 80/100 |

Industrial Applicability

The present invention provides a corrosion inhibitor composition which is convenient for use in the anticorrosion treatment of magnesium or magnesium alloy while permitting the metal to retain its metallic luster despite the treatment, and which is less likely to involve environmental problems, and also provides a process for inhibiting corrosion with use of the corrosion inhibitor composition.

The corrosion inhibitor composition of the invention is applicable to ingots and chips, which can be used as shaping materials as they are without removing the composition applied, free of any adverse effect on the shapability of the material or on the shaped articles obtained.

The corrosion inhibitor composition of the invention further has the outstanding advantage that when used for shaped articles, the articles can be directly coated over the applied composition without providing the step of removing the composition, effectively inhibiting the coated articles from developing corrosion or discoloring very easily.

The present invention further provides a surface treating agent and a surface treating process for shaped products of magnesium and/or magnesium alloy which can be used or practiced with a reduced number of steps and smaller equipment, decreased amounts of chemicals and diminished labor to achieve improved productivity and cost reductions, and also provides a process for producing magnesium and/or magnesium alloy components.

What is claimed is:

1. A surface treating agent for magnesium and/or magnesium alloy components which contains a phosphate which is at least one compound selected from the group consisting of an ammonium salt and an alkanolamine salt of phosphoric acid, and at least one compound selected from the group consisting of aromatic carboxylic acids and salts thereof.

2. A surface treating agent as defined in claim 1 wherein the phosphate is an ammonium condensed phosphate.

3. A surface treating agent for magnesium and/or magnesium alloy components which contains a phosphate which is at least one compound selected from the group consisting of an ammonium salt and an alkanolamine salt of phosphoric acid, at least one compound selected from the group consisting of aromatic carboxylic acids and salts thereof, and further at least one compound selected from the group consisting of pyrazole compounds and triazole compounds.

4. A surface treating agent as defined in claim 1 wherein the aromatic carboxylic acid and the salt thereof is cuminic acid, o-cuminic acid, m-cuminic acid, p-tert-butylbenzoic acid, m-toluic acid, o-toluic acid, p-toluic acid or an alkanolamine salt of these acids.

5. A surface treating agent as defined in claim 3 wherein the triazole compound is 1,2,3-triazole or 1,2,4-triazole.

6. A process for surface-treating magnesium and/or a magnesium alloy component, comprising applying to a surface of the magnesium and/or magnesium alloy component an agent for surface treatment containing a phosphate which is at least one compound selected from the group consisting of ammonium salt and alkanolamine salt of phosphoric acid, and at least one compound selected from the group consisting of aromatic carboxylic acids and salts thereof.

7. A process for surface-treating magnesium and/or a magnesium alloy component, comprising applying to a surface of the magnesium and/or magnesium alloy component an agent for surface treatment containing a phosphate which is at least one compound selected from the group consisting of ammonium salt and alkanolamine salt of phosphoric acid, at least one compound selected from the group consisting of aromatic carboxylic acids and salts thereof, and further at least one compound selected from the group consisting of pyrazole compounds and triazole compounds.

8. A process for treating magnesium and/or a magnesium alloy component, comprising applying to a surface of the magnesium and/or magnesium alloy component a surface treating agent for magnesium and/or magnesium alloy components which contains a phosphate, and at least one compound selected from the group consisting of aromatic carboxylic acids and salts thereof and thereafter treating the component with a corrosion inhibitor composition containing, as an effective component, at least one compound selected from the group consisting of aromatic carboxylic acids and salts thereof.

9. A process for producing a magnesium and/or magnesium alloys part by (1) optionally deburring a molded article of magnesium and/or magnesium alloys, (2) treating the article with the surface treating agent of claim 6, (3) washing the article with water and optionally treating the article for corrosion inhibition, (4) drying the article, (5) coating or plating the article, and (6) thereafter assembling the article.

10. A process for treating magnesium and/or a magnesium alloy component, comprising applying to a surface of the magnesium and/or magnesium alloy component a surface treating agent for magnesium and/or magnesium alloy components which contains a phosphate, and at least one compound selected from the group consisting of aromatic carboxylic acids and salts thereof and thereafter treating the component with a corrosion inhibitor composition containing at least one compound selected from the group consisting of aromatic carboxylic acids and salts thereof, and at least one compound selected from the group consisting of pyrazole compounds and triazole compounds.

11. A process for treating magnesium and/or a magnesium alloy component, comprising applying to a surface of the magnesium and/or magnesium alloy component a surface treating agent for magnesium and/or magnesium alloy components which contains a phosphate, at least one compound selected from the group consisting of aromatic carboxylic acids and salts thereof, and further at least one compound selected from the group consisting of pyrazole compounds and triazole compounds and thereafter treating the component with a corrosion inhibitor composition containing, as an effective component, at least one compound selected from the group consisting of aromatic carboxylic acids and salts thereof.

12. A process for treating magnesium and/or a magnesium alloy component, comprising applying to a surface of the magnesium and/or magnesium alloy component a surface treating agent for magnesium and/or magnesium alloy components which contains a phosphate, at least one compound selected from the group consisting of aromatic carboxylic acids and salts thereof, and further at least one compound selected from the group consisting of pyrazole compounds and triazole compounds and thereafter treating the component with the corrosion inhibitor composition containing at least one compound selected from the group consisting of aromatic carboxylic acids and salts thereof, and at least one compound selected from the group consisting of pyrazole compounds and triazole compounds.

13. A process for producing a magnesium and/or magnesium alloys part by (1) optionally deburring a molded article of magnesium and/or magnesium alloys, (2) treating the article with the surface treating agent of claim 8, (3) washing the article with water and optionally treating the article for corrosion inhibition, (4) drying the article, (5) coating or plating the article, and (6) thereafter assembling the article.

14. A process for producing a magnesium and/or magnesium alloys part by (1) optionally deburring a molded article of magnesium and/or magnesium alloys, (2) treating the article with the surface treating agent of claim 9, (3) washing the article with water and optionally treating the article for corrosion inhibition, (4) drying the article, (5) coating or plating the article, and (6) thereafter assembling the article.

15. A process for producing a magnesium and/or magnesium alloys part by (1) optionally deburring a molded article of magnesium and/or magnesium alloys, (2) treating the article with the surface treating agent of claim 10, (3) washing the article with water and optionally treating the article for corrosion inhibition, (4) drying the article, (5) coating or plating the article, and (6) thereafter assembling the article.

16. A process for producing a magnesium and/or magnesium alloys part by (1) optionally deburring a molded article of magnesium and/or magnesium alloys, (2) treating the article with the surface treating agent of claim 11, (3) washing the article with water and optionally treating the article for corrosion inhibition, (4) drying the article, (5) coating or plating the article, and (6) thereafter assembling the article.

* * * * *